United States Patent [19]

Kice

[11] Patent Number: 5,031,514

[45] Date of Patent: Jul. 16, 1991

[54] APPARATUS AND METHOD FOR CONTROLLING THE MIXING OF ATMOSPHERIC AIR WITH RETURN AIR FROM A BUILDING

[76] Inventor: John E. Kice, 8330 Huntington, Wichita, Kans. 67206

[21] Appl. No.: 404,557

[22] Filed: Sep. 8, 1989

[51] Int. Cl.[5] ..... F24F 13/04

[52] U.S. Cl. ..... 98/34.5

[58] Field of Search ..... 98/34.5, 34.6, 38.7; 236/13; 137/606

[56] References Cited

U.S. PATENT DOCUMENTS

| | | | |
|---|---|---|---|
| 1,753,156 | 4/1930 | Otis | 98/38.7 X |
| 1,990,468 | 2/1935 | Bridges | 98/38.7 X |
| 2,190,242 | 2/1940 | Heiman | 98/34.6 X |
| 4,605,160 | 8/1986 | Day | 98/38.7 X |

*Primary Examiner*—Harold Joyce

*Attorney, Agent, or Firm*—John Wade Carpenter

[57] ABSTRACT

An apparatus for controlling the mixing of atmospheric air with return air from a building. The apparatus has a housing that includes a base baffle and a roof baffle disposed therein. A damper is pivotally secured to the base baffle, and another damper is pivotally secured to the roof baffle. The two dampers are interconnected pivotally by a damper linkage such that when the first damper is caused to be pivoted on and about the base baffle, the other damper pivots on and about the roof baffle. An actuator is provided such as to be supported by the base. The actuator pivotally connects to the damper that pivotally connects to the base baffle such that when the actuator is actuated, the damper that pivotally connects to the base baffle is caused to be pivoted on and about the same. A method for controlling the mixing of atmospheric air with return air from a building.

14 Claims, 6 Drawing Sheets

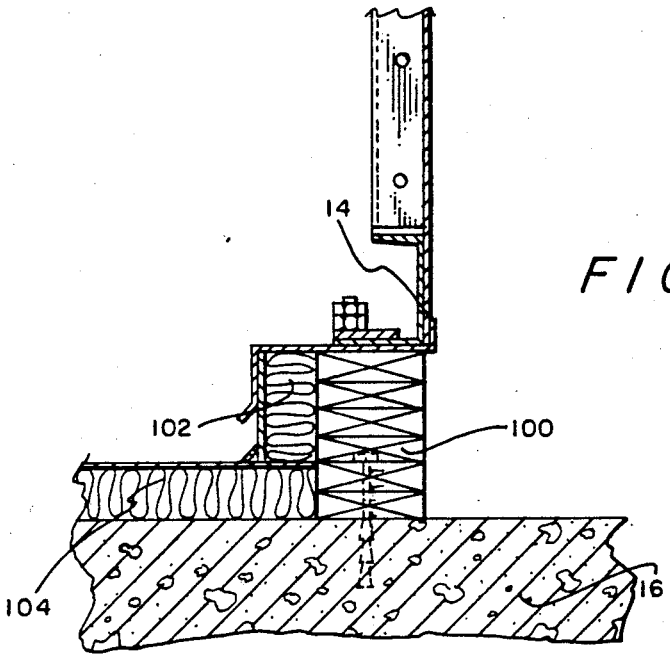
FIG. 9
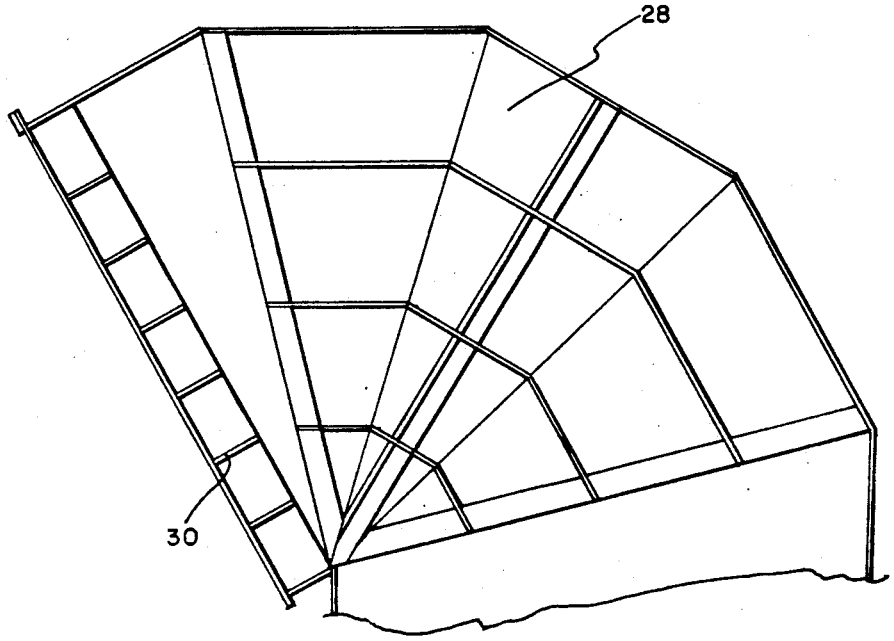
FIG. 8
FIG. 10
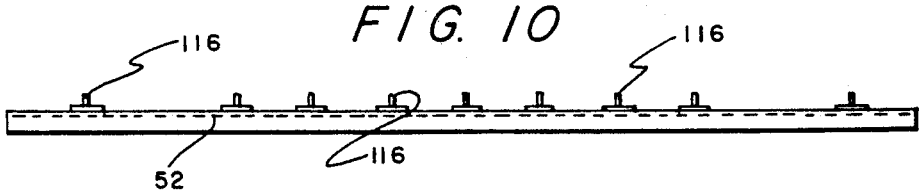

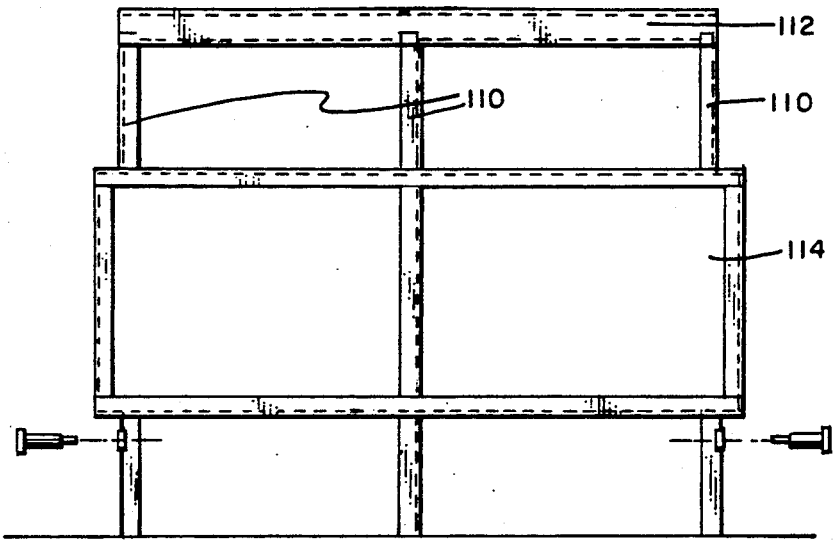
FIG. 11
FIG. 12
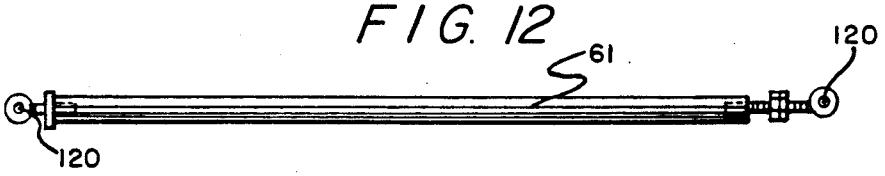
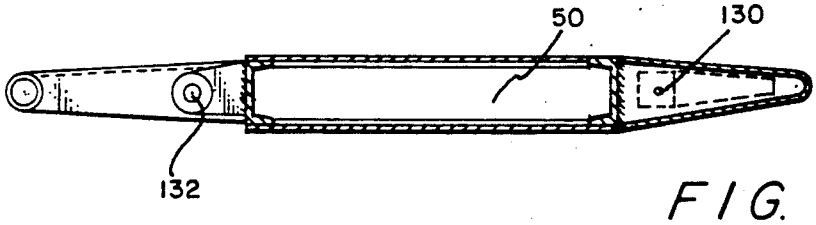
FIG. 13
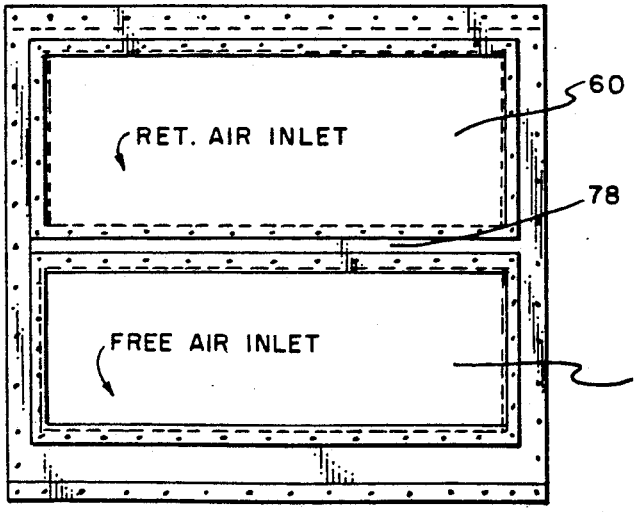
FIG. 14

APPARATUS AND METHOD FOR CONTROLLING THE MIXING OF ATMOSPHERIC AIR WITH RETURN AIR FROM A BUILDING

BACKGROUND OF THE INVENTION

1. Field of the Invention

This invention is related to an apparatus and method for controlling the mixing of air. More specifically, this invention provides an apparatus and method for controlling the mixing of atmospheric air with returned air from a building.

2. Description of the Prior Art

A patentability investigation was conducted and the following prior art U.S. Pats. were discovered: U.S. Pat. No. 2,327,664 to Otis; U.S. Pat. No. 4,336,748 to Martin et al.; U.S. Pat. No. 4,570,532 to Labelle; U.S. Pat. No. 4,589,476 to Berner. None of the foregoing prior art patents teach or suggest the particular method and apparatus of this invention.

SUMMARY OF THE INVENTION

The present invention broadly accomplishes its desired objects by broadly providing an apparatus for controlling the mixing of atmospheric air with return air from a building. The apparatus has a housing that includes a base; and an intake end means for intaking air, an outlet end means for exiting an air mixture, and a pair of opposed sides, all supported by the base. A roof is mounted to the intake end means and to the outlet end means and to the opposed sides. The roof has an exhaust outlet wherethrough return air from a building may be exhausted. A base baffle means is supported by the base of the housing. A roof baffle means is secured to the roof of the house and extends down therefrom to deflect returned air from a building towards the exhaust outlet. The apparatus of the present invention additionally comprises a first damper means pivotally secured on and to the base baffle means for regulating the quantity of atmospheric air passing by the first damper means, and a second damper means pivotally secured to and on the roof baffle means for regulating the quantity of return air passing by the second damper means. A damper linkage means is connected pivotally to both the first damper means and to the second damper means such that when the first damper means is caused to be pivoted on and about the base baffle means, the second damper means pivots on and about the roof baffle means. The apparatus yet further includes an actuator means supported by the base and pivotally connected to the first damper means such that when the actuator means is actuated, the first damper means is caused to be pivoted on and about the base baffle means. The intake end means includes a free-air inlet opening wherethrough the atmospheric air passes, and a return-air inlet wherethrough return air from a building passes. A separating member separates the free-air inlet opening and the return-air inlet opening and extends into the inside of the housing and terminates in a separating member end.

The present invention further broadly accomplishes its desired objects by broadly providing a method for controlling the mixing of atmospheric air with return air from a building comprising the steps of:

(a) forming a housing having a base baffle means, a roof baffle means, a free-air inlet opening wherethrough atmospheric air passes, and a return-air inlet wherethrough return air from a building passes;

(b) connecting pivotally a first damper means to the base baffle means for regulating the quantity of atmospheric air that flows by the first damper means;

(c) connecting pivotally a second damper means to the roof baffle means for regulating the quantity of return air that flows by the second damper means;

(d) pivoting simultaneously the first damper means on and about the base baffle means and the second damper means on and about the roof baffle means, such that the first damper means and the second damper means can regulate the quantity of atmospheric air mixed with return air.

It is therefore an object of the present invention to provide an apparatus for controlling the mixing of atmospheric air with return air from a building.

It is yet another object of the present invention to provide a method for controlling the mixing of atmospheric with return air from a building.

These, together with the various ancillary objects and features which will become apparent to those skilled in the art as the following description proceeds, are attained by this novel apparatus and method, a preferred embodiment being shown with reference to the accompanying drawings, by way of example only, wherein:

BRIEF DESCRIPTION OF THE DRAWINGS

FIG. 8 is a side elevational view of the exhaust hood;

FIG. 9 is a partial vertical sectional view of the curb which is included within the base of the housing of the apparatus;

FIG. 10 is a side elevational view of the angle iron or actuator support channel to which is attached at least one actuator;

FIG. 11 is a partial horizontal sectional view and top plan view of a damper;

FIG. 12 is a top plan view of the linkage that interconnects the two dampers;

FIG. 13 is a side elevational view of a damper; and

FIG. 14 is a front elevational view of the intake end means of the housing of the apparatus.

DETAILED DESCRIPTION OF THE INVENTION

Figure 3:
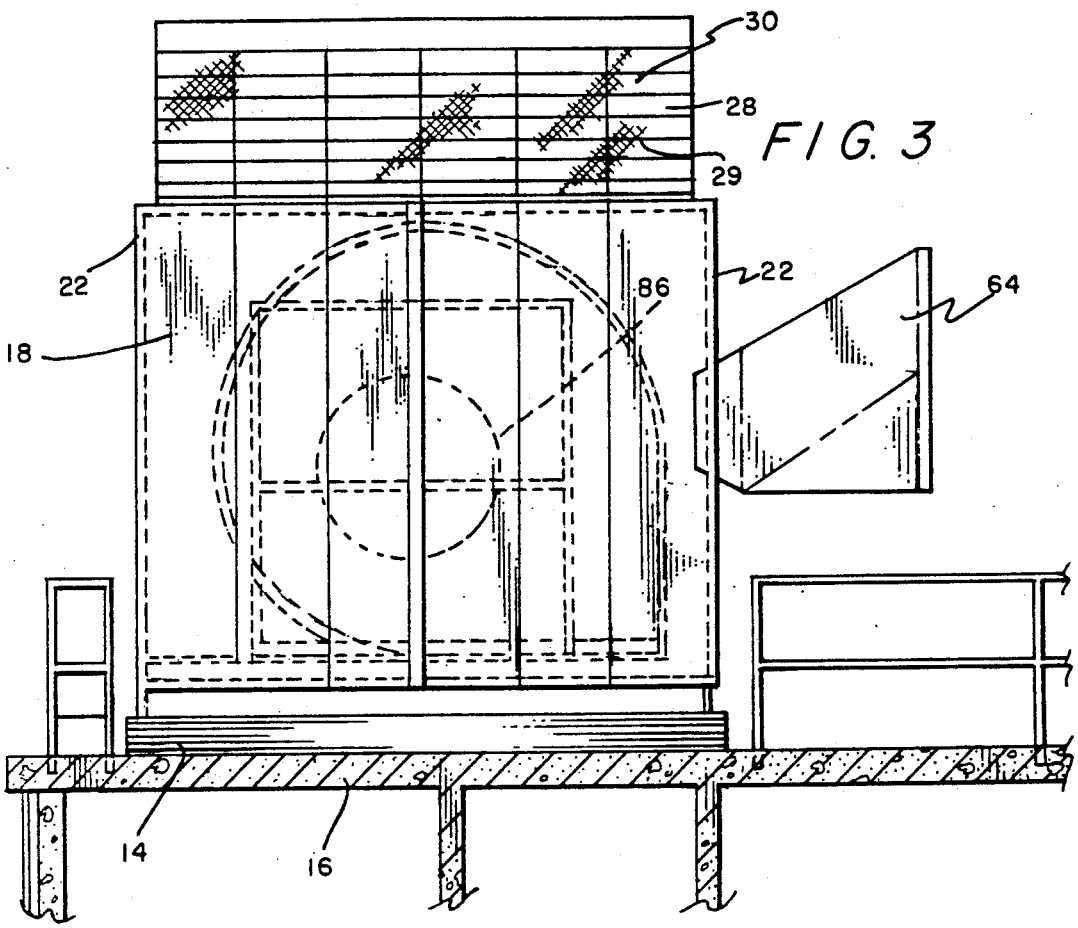
FIG. 3 is an end elevational view of the apparatus of this invention.

Referring in detail now to the drawings, wherein similar parts of the invention throughout the various views in the drawings are identified by like reference numerals, there is seen the apparatus, generally illustrated as 10, of this invention for controlling the mixing of atmospheric air with return air from a building, such as a plant and the like. The apparatus 10 comprises a housing 12 having a base 14 which typically rests on a foundation 16. Connected to and supported by the base 14 are an outlet end 18 for exiting an air mixture into a building, an intake end, generally illustrated as 20, for intaking air (i.e., return air from a building and atmospheric air from the atmosphere), and a pair of sides 22–22 connected to both the outlet end 18 and the intake end 20. One of the sides 22 has a pair of removable plates 23. A roof 24 is connected to and supported by the outlet end 18, the intake end 20, and the pair of sides 22–22. The roof 24 has an exhaust outlet or opening 26 wherethrough return air from the building can pass. Mounted on the roof 24 and more specifically around the periphery of the exhaust opening 26 is a hollow exhaust hood 28 for conducting return air from the building away from the housing 12 and emitting the same into the atmosphere. As best shown in FIG. 3, a plurality of partition members 29 is disposed within the hollow exhaust hood 28 and a screen 30 may be secured around the outside opening of the exhaust hood 28 for preventing birds and the like from entering the exhaust hood 28.

Figure 5:
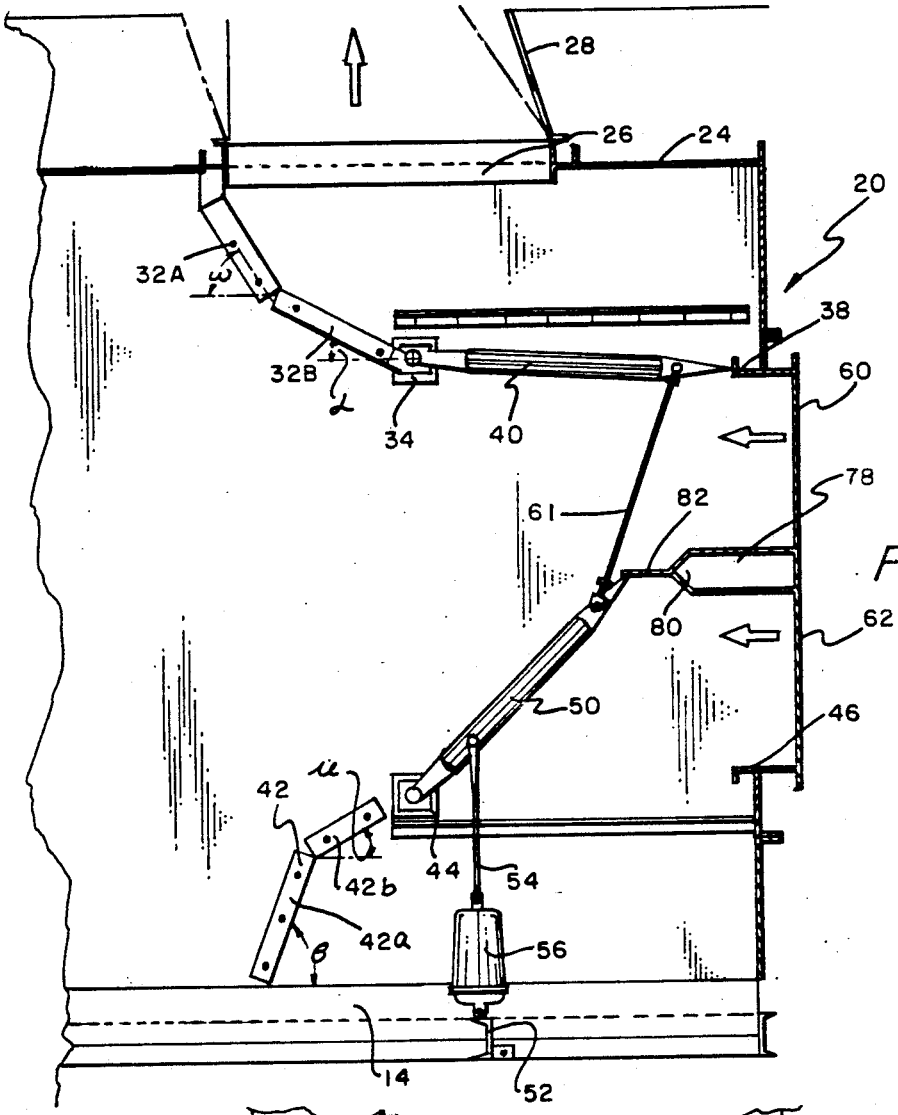
FIG. 5 is a vertical sectional view of the apparatus, clearly depicting the pair of dampers pivotally secured within the apparatus and interconnected by a linkage means such that when one of the dampers is moved by the actuator, the other damper moves with the actuated damper.
Figure 6:
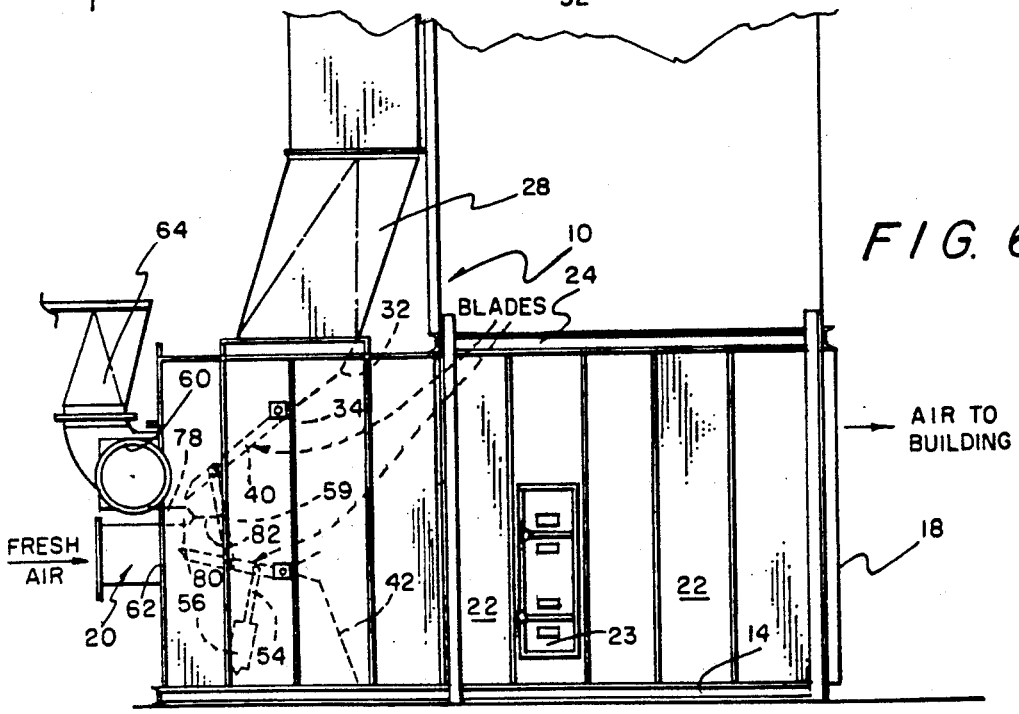
FIG. 6 is a side elevational view of the apparatus of this invention.
Figure 7:
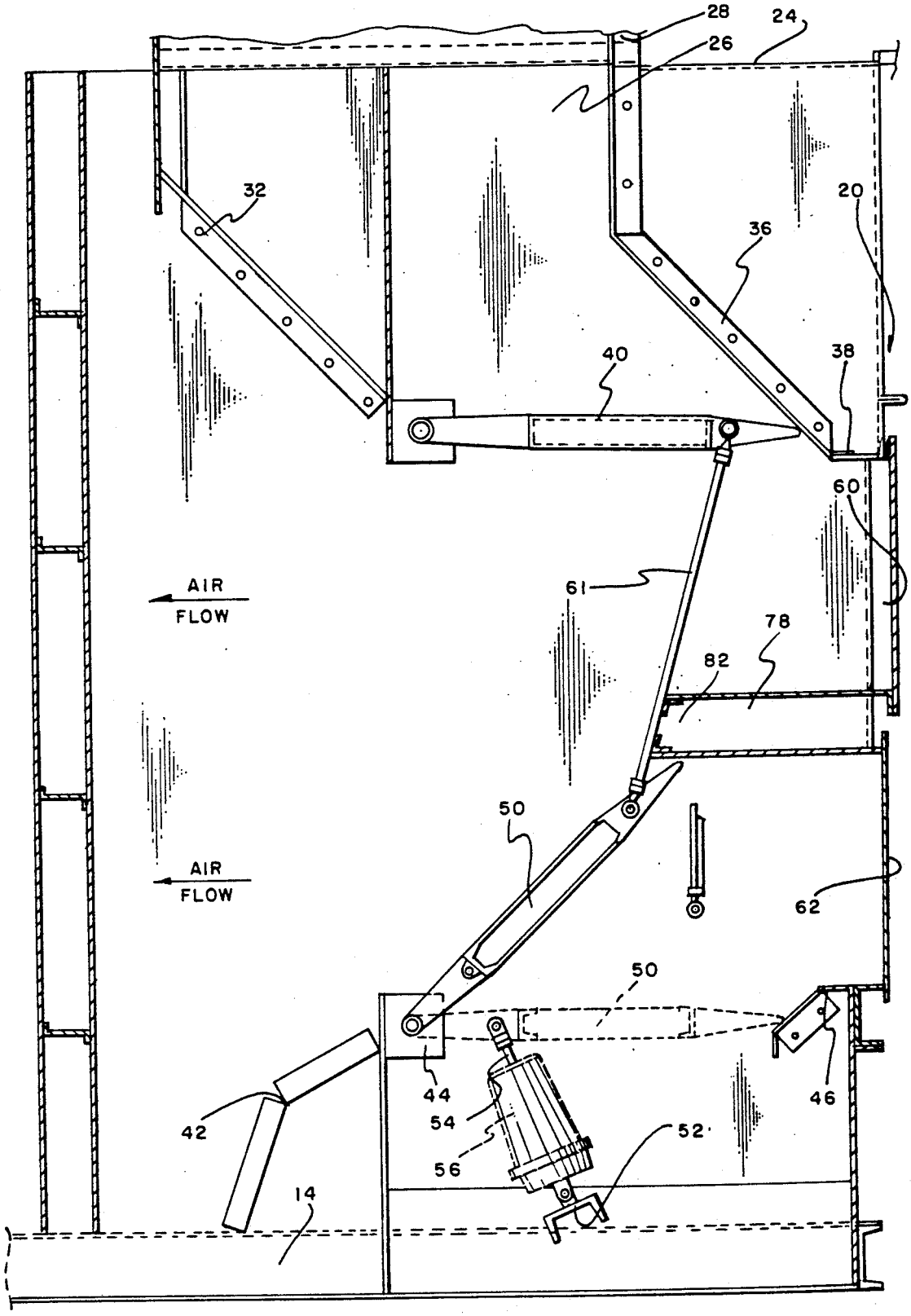
FIG. 7 is another partial vertical sectional view of the apparatus of this invention similar to the partial sectional view in FIG. 5.

Attached and bound to the roof 24 on the inside of the housing 12, and preferably in proximity to the rear periphery of the exhaust opening 26, is at least one roof baffle 32. The roof baffle 32 traverses the width of the housing 12 to connect to the sides 22–22 and extends down into the housing 12 towards the base 14 thereof. As best shown in FIG. 5, the roof baffle 32 comprises a pair of interconnected baffle sections **32*a*14 32*b* which together form an arcuate shaped roof baffle 32. Baffle section 32*b* (towards the outlet end 18) forms an angle with a horizontal plane. Angle $\alpha$ is preferably an acute angle varying from about 5 degrees to about 85 degrees. Similarly, baffle section 32*a* (towards the outlet end 18) forms an angle $\omega$ with a horizontal plane which is also an acute angle and may vary from about 5 degrees to about 85 degrees. Baffle section 32*a* connects to the roof 24. The baffle section 32*b* terminates in at least one upper support member 34 which connects to the pair of sides 22–22 and straddles the width of the housing 12. At least one upper channeling member 36 (see FIG. 1) is connected to the housing 12 on the inside thereof; more specifically, the channeling member 36 connects to the roof 24 and/or to the intake end 20 on the inside of the housing 12 and has a bottom defining a groove or upper lip means or member 38 which protrudes towards the outlet end 18 from the intake end 20 on the inside of the housing 12. At least one upper damper blade 40 is pivotally connected to the upper support member 34**.

Mounted to the base 14 and supported thereby is a base baffle 42 for deflecting atmospheric air. As best shown in FIG. 5, the base baffle 42 comprises a baffle section **42*a* supported directly by the base 14 and a baffle section 42*b* connected to the baffle section 42*a*. Similar to baffle sections 32*a*–32*b*, baffle sections 42*a* and 42*b* combine such that the base baffle 42 has an arcuate shape. Baffle section 42*a* (towards the intake end 20) forms an angle $\beta$ with a horizontal plane. Angle $\beta$, is preferably an acute angle that ranges from about 5 degrees to about 85 degrees. Baffle section 42*b* (towards the intake end 20) defines an angle $\mu$ with a horizontal plane (relative to base 14). Angle $\mu$ has a value which preferably varies from about 5 degrees to about 85 degrees. As further best shown in FIG. 5, baffle section 42*a* connects to and is supported by the base 14. Baffle section 42*b* terminates in at least one lower support member 44. Lower support member 44 is similar to upper support member 34 in that it straddles the width of the housing 12 and connects to the pair of sides 22—22. A lower lip means or member 46 is bound to the intake end 20 and extends towards the outlet end 18 on the inside of the housing 12. At least one lower damper blade 50 is pivotally connected to the lower support member 44**.

Supported by and connected to the base 14 is an angle iron member 52. At least one activator member 54 is mounted to the angle iron member 52, and includes a slidably lodged piston 56 that pivotally connects to the lower damper 50. The actuator 54 may be activated hydraulically or pneumatically, preferably pneumatically. A pilot actuator control box (not shown) is mounted to the actuator 54, and is engaged to a pneumatic thermostat (not shown) which is preferably positioned on the inside of the building whose atmosphere is to be controlled by the apparatus 10 of this invention. The entire control system or circuit for the apparatus 10 may be any suitable control system employing both the pilot actuator control box and the pneumatic thermostat, such as that disclosed in U.S. Pat. No. 4,495,113 which is fully incorporated herein by reference thereto. Pivotally connected to the upper and lower dampers 40 and 50 is a damper linkage 61 such that when the lower damper 50 is caused to be pivoted on and about the base baffle 42 by the actuator 56, the upper damper 40 pivots on and about the roof baffle 32.

Figure 4:
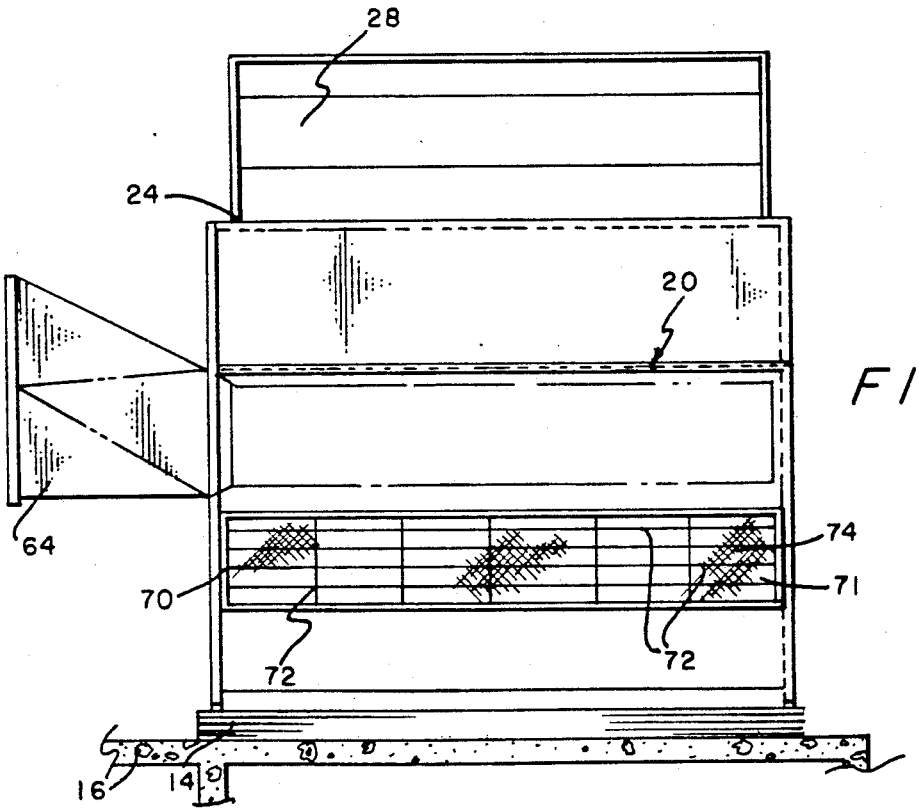
FIG. 4 is another end elevational view of the apparatus of this invention.

The intake end 20 of the apparatus 10 comprises a return-air inlet 60 wherethrough return air from a building passes, and a free-air inlet 62 wherethrough atmospheric air passes. The return air inlet 60 includes secured therearound a hollow inlet hood 64 having an opening 66 communicating with the inside of the building. A plurality of vanes 68 is pivotally disposed in the inlet hood 64 to assist in controlling the quantity and direction of flow of return air. A pressure fan (not shown in the drawings) is disposed in the inlet hood 64 (or outside thereof but in communication with the opening 66) to force return air therethrough. A hollow intake hood 70 with an opening 71 is mounted around the return-air inlet 60. A plurality of partition members 72 is disposed within the hollow intake hood 70. A screen member 74 (see FIG. 4) covers the opening 71 to keep birds, insects and the like from entering the housing 12. Separating the free-air inlet 62 and the return-air inlet 60 is a separating member 78 which extends into the inside of the housing 12 and terminates in a separating member end 80. As best shown in FIG. 5, the separating member end 50 is formed with a separating lip 82. The separating member end 80 (including the separating lip 82) and the upper lip means 38 defines the extremity points or boundaries of pivotation for the upper damper 40. Similarly, the separating member end 80 (including the separating lip 82) and the lower lip means 46 define the extremity points or boundaries for the pivotation of the lower damper 50.

Mounted in the housing 12 between the outlet end 18 and the roof baffle 32 and the base baffle 42 is a filter rack 76 (or filter bank) to filter the air passing therethrough. Between the outlet end 18 and the filter rack 76 is a suction fan 86 to suck air through the filter rack 76 and blow same into the building.

The base 14 of the apparatus 10 of this invention, as best illustrated in FIG. 9, is mounted with the inclusion of mounting base 100 and insulations 102 and 104. The damper blades 40 and 50 each include a pair of parallel struts 110 terminating at one end in a damper end 112 (see FIG. 11). Furthermore, each of the dampers 40 and 50 comprise an outside shell 114 that is secured to each of the struts 110. Each angle iron member 52 comprises at least one angle lug to which an actuator 56 may be secured. As indicated, the angle iron member 52 is secured to the base 14 of the housing 12. Each damper linkage 61, as best shown in FIG. 12, includes a pair of eyelets 120—120. One of the eyelets 120 pivotally connects at point 130 on the damper blade 50, and the other eyelet 120 connects to a similar location on damper blade 40. The actuator 56 pivotally connects to damper blade 50 at the location indicated as 132 in FIG. 13.

Figure 1:
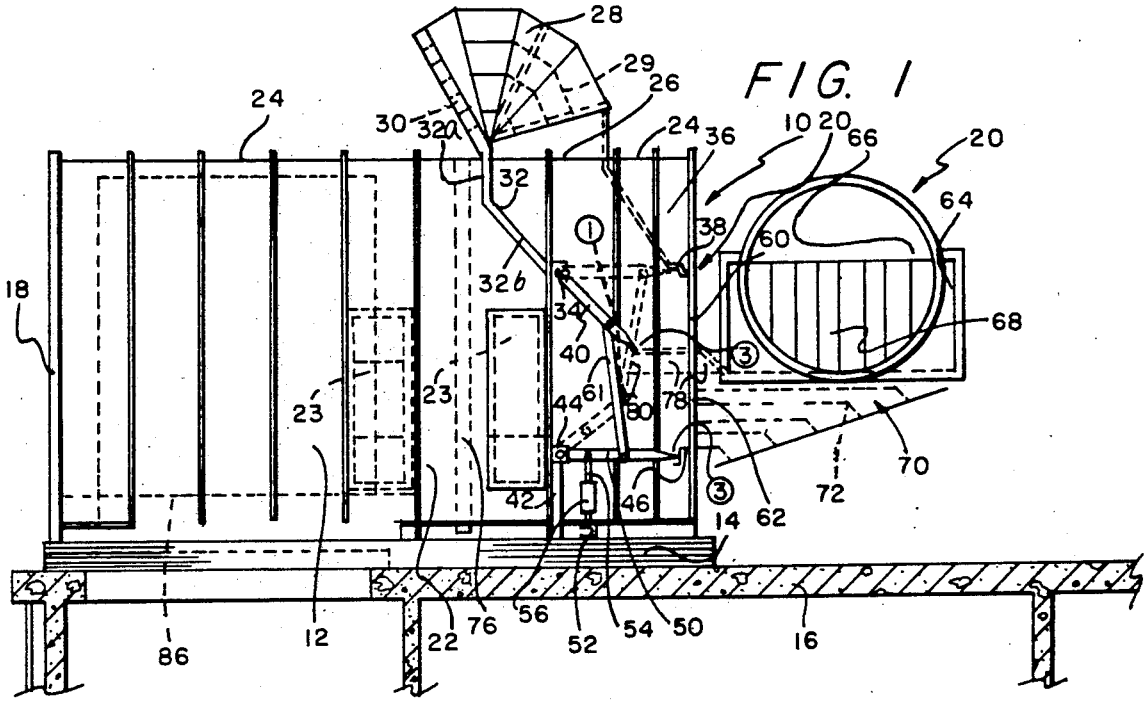
FIG. 1 is a partial vertical sectional view of the apparatus of this invention for controlling the mixing of atmospheric air with return air from a building.
Figure 2:
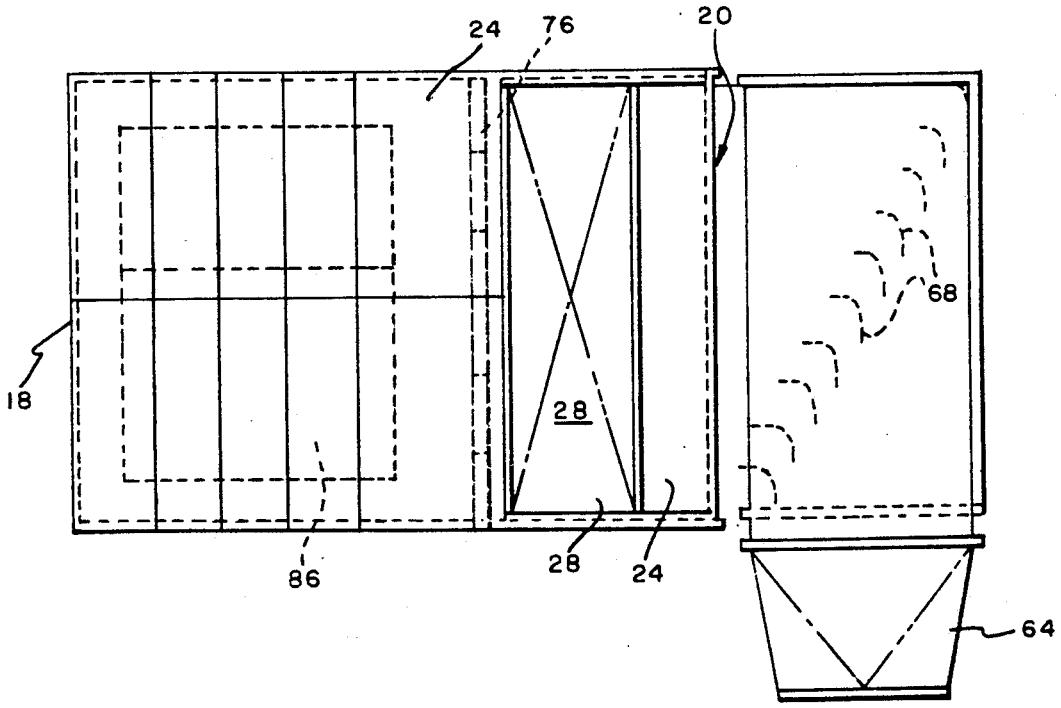
FIG. 2 is a top plan view of the apparatus of this invention.

With continuing reference to the drawings for operation of the invention, the apparatus 10 of this invention is employed with fans to move filtered air to and from a building, such as a plant. It is thermostatically controlled to recycle and conserve heat produced by motors, process operations, and all of the like, on cold days, or to exhaust internal heat and bring in fresh outside air as required to hold or maintain a set room temperature within the building or plant. Referring more particularly now to FIG. 1, position "①" is the full recycle position. In this position, all of the heat generated in the process within the plant or building is recycled and is used to warm the building during the coldest weather. Fresh air intake through free-air inlet 62 is completely blocked by lower damper 50. Furthermore, upper damper 40 completely blocks off the exhaust outlet 26 such that all of the return air from the plant is passed through the return-air inlet 60 and directly towards the filter rack or bank 76 without any portion thereof being bypassed or channeled through exhaust outlet 26.

Continuing to refer to FIG. 1, position "③" is the full exhaust position wherein heat generated by the motors and process operations is removed through the exhaust outlet 26. Thus, position "③" for the dampers 40 and 50 allows no return air to be recharged back into the plant. The air that exits outlet end 18 is the cooler outdoor air that has been taken in through free-air inlet 62. This is the position for warm summer days. It is to be understood that equipment can be added downstream of outlet end 18 to further cool and humidify the air exiting out of outlet end 18.

In between the position"①" and position "③" for the dampers 40 and 50, is a neutral position wherein return air through return-air inlet 60 is mixed with atmospheric air through free-air inlet 62. As previously indicated, the conditions inside the plant are thermostatically controlled. When the working conditions become too cold within the plant or building, the thermostat located therein via the control panel causes the piston 54 of the actuator 56 to expand or slide outwardly and/or upwardly causing the lower damper 50 to pivot up. As damper 50 pivots up, the upper damper 40 simultaneously also pivots due to the pivotally interconnected linkage member 61. With damper blade 50 pivoting upwardly towards the separating member 78, and the damper blade 40 pivoting upwardly towards the upper lip means 38, less atmospheric air is allowed to pass through free-air inlet 62, and more return air is allowed to bypass or proceed by damper 40 and into and towards the filter rack 76 of the housing 12 to mix with the atmospheric air that has passed through free-air inlet 62. Obviously, with less cooler atmospheric air passing through free-air inlet 62, and bypassing damper 50, and more warmer return air passing through return-air inlet 60 and bypassing damper 40, the mixture of the two inflowing air systems becomes warmer. Thus, when more heat is needed within the plant or building, the damper blades 40 and 50 are rotated slightly counter-clockwise to recycle more warm return air from the plant/building, to decrease the exhaust air stream through outlet 26, and decrease the fresh air intake stream through inlet 62. Similarly, when the conditions within the plant become too warm, the thermostat therein causes the actuator 56 through an actuator control panel to retract the piston 54. Such retraction causes damper blade 50 to pivot downwardly and clockwise towards the base, which in turn simultaneously causes the damper blade 40 to also pivot in the same direction and to the same degree due to the pivotally interconnected damper linkage 61. As the dampers 40 and 50 pivot downwardly, more atmospheric air is allowed to bypass the damper 50 and less return air is allowed to bypass damper 40. As the quantity of atmospheric air increases, the quantity of return air from the plant decreases, and the mixture of return air and atmospheric air tends to become cooler. Thus, when less heat is needed within the plant, the dampers 40 and 50 rotate slightly clockwise (or towards the base 14) to recycle less warm air eminating from the return air passing through return-air inlet 60, and to increase the exhaust air stream passing through exhaust outlet or opening 26; and to further increase the fresh air intake bypassing damper 50 and eminating through free air passing through free-air inlet 62.

Thus, the apparatus 10 of this invention performs two main functions of preserving the air balance in a building by returning and exhausting equal amounts of air, and secondly returning a proportioned of heat generated from motors and process conditions within the building and maintaining a set temperature within the building. Air streams are brought in from within the building and from the atmosphere outside of the building. The two wing-shaped dampers 40 and 50 with the innerconnecting linkage 61 can be set to return all building air (typically heated air) back into the building. If the thermostat located within the building dictates for a change in air mix temperature, the actuator 56 will slowly retract and reposition both damper blades 40 and 50 to allow fresh air to mix with return air and to be discharged back into the building through the filter bank 76 and the outlet end 18, with an approximately equal amount of air diverted out of the building over the damper 40 and through outlet 26. This provides for a set temperature to be maintained within the building along with maintaining the air balance in the building. With the actuator 56 retracted, the damper blades 40 and 50 may drop down to a position (i.e., position "③" ) where only fresh air is returned into the building through the suction fan 86, and all building air or return air blowing from a fan into the return-air inlet 60 is exhausted through outlet 26.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth. It is understood that the apparatus of the present invention can be employed in a refrigeration plant where cold outside air replaces refrigeration as illustrated in U.S. Pat. No. 4,495,113 which is fully incorporated by reference herein.

I claim:

1. An apparatus for controlling the mixing of atmospheric air with return air from a building comprising:

(a) a housing having a base, an intake end means for intaking air and supported by the base, an outlet end means for exiting an air mixture and supported by the base, a pair of opposed sides supported by the base, and a roof mounted to the intake end means and to the outlet end means and to the opposed sides, and said roof has a structure defining an exhaust outlet;

(b) a first damper means for regulating the quantity of atmospheric air passing by the first damper means;

(c) a second damper means for regulating the quantity of return air passing by the second damper means;

(d) a base baffle means for pivotally engaging said second damper means, said base baffle means being supported by said base of the housing;

(e) a roof baffle means for pivotally engaging said second damper means, said roof baffle means being secured to said roof and extending down therefrom to deflect return air from a building towards the exhaust outlet, said first damper means being pivotally secured on and to said base baffle means and said second damper means being pivotally secured to and on said roof baffle means;

(f) a damper linkage means connected pivotally to the first damper means and to the second damper means such that when said first damper means is caused to be pivoted on and about the base baffle means, said second damper means pivots on and about the roof baffle means; and (g) an actuator means supported by said base and pivotally connected to said first damper means such that when the actuator means is actuated said first damper means is caused to be pivoted on and about said base baffle means.

2. The apparatus of claim 1 wherein said intake end means comprises a free-air inlet opening wherethrough the atmospheric air passes, and a return-air inlet opening wherethrough return air from a building passes, and a separating member which separates the free-air inlet opening and the return-air inlet opening and extends into the inside of said housing and terminates in a separating member end.

3. The apparatus of claim 2 wherein said separating member end comprises a separator lip protruding therefrom.

4. The apparatus of claim 2 additionally comprising a lower lip member protruding into the inside of the housing from the free-air inlet opening.

5. The apparatus of claim 2 additionally comprising an upper lip member protruding into the inside of the housing from the return-air inlet.

6. The apparatus of claim 2 additionally comprising a filter rack positioned within the housing between the base baffle means and the roof baffle means.

7. The apparatus of claim 1 wherein said base baffle means comprises a first base baffle member secured to the base and a second base baffle member secured to the first base baffle member and forming an acute angle with a horizontal plane.

8. The apparatus of claim 1 wherein said roof baffle means comprises a first roof baffle member secured to the roof and a second roof baffle member secured to the first roof baffle member and forming an acute angle with a horizontal plane.

9. The apparatus of claim 8 additionally comprising an upper support member connected to said second roof baffle member, and a lower support member connected to said second base baffle member.

10. The apparatus of claim 9 wherein said second damper means pivotally connects to said upper support member and said first damper means pivotally connects to said lower support member.

11. The apparatus of claim 1 additionally comprising a fan disposed in said housing between said intake end means and said outlet end means.

12. The apparatus of claim 2 additionally comprising a fan disposed in said housing between said intake end means and said outlet end means.

13. The apparatus of claim 1 additionally comprising an exhaust hood secured to said roof such that said exhaust outlet communicates with an inside of said exhaust hood.

14. The apparatus of claim 2 additionally comprising an exhaust hood secured to said roof such that said exhaust outlet communicates with an inside of said exhaust hood.

* * * * *